US009136576B2

(12) United States Patent
Hashimoto et al.

(10) Patent No.: US 9,136,576 B2
(45) Date of Patent: Sep. 15, 2015

(54) CONNECTING STRUCTURE FOR A WAVEGUIDE CONVERTER HAVING A FIRST WAVEGUIDE SUBSTRATE AND A SECOND CONVERTER SUBSTRATE THAT ARE FIXED TO EACH OTHER

(75) Inventors: Minoru Hashimoto, Tokyo (JP); Shigeo Udagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 520 days.

(21) Appl. No.: 13/266,909

(22) PCT Filed: Jan. 15, 2010

(86) PCT No.: PCT/JP2010/050418

§ 371 (c)(1),
(2), (4) Date: Oct. 28, 2011

(87) PCT Pub. No.: WO2010/125835

PCT Pub. Date: Nov. 4, 2010

(65) Prior Publication Data

US 2012/0050131 A1 Mar. 1, 2012

(30) Foreign Application Priority Data

Apr. 28, 2009 (JP) ..... 2009-109558

(51) Int. Cl.
*H01P 5/107* (2006.01)
*H01P 1/04* (2006.01)

(52) U.S. Cl.
CPC ..... *H01P 5/107* (2013.01); *H01P 1/042* (2013.01); *Y10T 29/49018* (2015.01)

(58) Field of Classification Search
CPC ..... H01P 5/107; H01P 1/042
USPC ..... 333/26, 254
See application file for complete search history.

(56) References Cited

U.S. PATENT DOCUMENTS 7,388,450 B2 * 6/2008 Camiade et al. ..... 333/26
7,436,679 B2 10/2008 Iijima et al.

(Continued)

FOREIGN PATENT DOCUMENTS

JP H 11-74708 3/1999
JP 2002 164663 6/2002

(Continued)

OTHER PUBLICATIONS

Chinese Office Action issued Jul. 2, 2013, in China Patent Application No. 201080018946.0 (with English translation).

(Continued)

*Primary Examiner* — Benny Lee
(74) *Attorney, Agent, or Firm* — Oblon, McClelland, Maier & Neustadt, L.L.P.

(57) ABSTRACT

A connecting structure of a waveguide converter includes a circuit substrate in which a hollow waveguide that propagates a high frequency signal is formed in a pierced manner; and an antenna substrate that is layered on the circuit substrate, and in which a converter that is arranged at a connecting point with the hollow waveguide and a strip line that extends from the converter and that propagates the high frequency signal are provided. A choke circuit to shield a leak of the high frequency signal is arranged around the hollow waveguide on a surface of the circuit substrate opposing to the antenna substrate so as to surround the hollow waveguide keeping a predetermined interval from the hollow waveguide, and the circuit substrate and the antenna substrate are fixed to each other by adhesive that is arranged at a position outside the choke circuit, between the substrates.

11 Claims, 4 Drawing Sheets

(56) References Cited

U.S. PATENT DOCUMENTS

| | | | | |
|---|---|---|---|---|
| 7,479,841 | B2 * | 1/2009 | Stenger | 333/26 |
| 2003/0042993 | A1 * | 3/2003 | Sayanagi et al. | 333/26 |
| 2009/0309680 | A1 * | 12/2009 | Suzuki | 333/254 |

FOREIGN PATENT DOCUMENTS

| | | |
|---|---|---|
| JP | 2003 188601 | 7/2003 |
| JP | 2006-253953 | 9/2006 |
| JP | 2007 318348 | 12/2007 |
| JP | 2007 336299 | 12/2007 |
| JP | 2008 252207 | 10/2008 |
| JP | 2009 296491 | 12/2009 |
| WO | 2006 098054 | 9/2006 |
| WO | 2009 017203 | 2/2009 |
| WO | 2009 041696 | 4/2009 |

OTHER PUBLICATIONS

Office Action issued May 21, 2013, in Japanese Patent Application No. 2011-511332 with English translation.

International Search Report Issued Apr. 20, 2010 in PCT/JP10/050418 Filed Jan. 15, 2010.

Extended European Search Report issued Mar. 27, 2015 in Patent Application No. 10769535.5.

Office Action issued Dec. 16, 2014 in Japanese Patent Application No. 2013-206363 (with English language translation).

Office Action issued Aug. 12, 2014 to Japanese Patent Application No. 2013-206363, with English translation.

* cited by examiner

CONNECTING STRUCTURE FOR A WAVEGUIDE CONVERTER HAVING A FIRST WAVEGUIDE SUBSTRATE AND A SECOND CONVERTER SUBSTRATE THAT ARE FIXED TO EACH OTHER

FIELD

The present invention relates to a connecting structure of a waveguide converter in which a hollow waveguide and a transmission line are formed to transmit high frequency signals from the hollow waveguide to the transmission line, or from the transmission line to the hollow waveguide, a manufacturing method thereof, and an antenna apparatus in which the structure is applied.

BACKGROUND

Conventionally, as small antennas that are used in microwave or millimeter-wave radar or communication devices, a waveguide slot antenna in which a waveguide is formed with a metallic material and in which air in the waveguide is used as a medium to transmit high frequency signals, or a triplate antenna that is constituted by a resin substrate and a metallic plate, and in which air between the substrate and the metallic plate is used as a medium to transmit high frequency signals are known.

FIG. 6 is a cross section illustrating an example of a structure of radar equipped with a triplate antenna. As shown in FIG. 6, a radar apparatus 201 has such a structure that a triplate antenna 3 and a circuit substrate 2 are fixed by fixing screws 14 to a waveguide plate 10 that is sandwiched therebetween.

The triplate antenna 3 has such a structure that two pieces of metallic plates 7 are opposed to each other at a predetermined interval, and that a resin antenna substrate 4 is layered on one of the metallic plates 7. On a surface of the antenna substrate 4, multiple antenna devices 5 and an antenna line 6 that propagates high frequency signals to the antenna devices 5 are arranged. Moreover, in the metallic plate 7 on which the antenna substrate 4 is not arranged, a waveguide converter 8 is formed at a position opposing to a hollow waveguide 11, on a surface opposing to the hollow waveguide 11, and vias 9 are opened at positions opposing to the antenna devices 5, respectively.

In the circuit substrate 2, the hollow waveguide 11 is arranged piercing therethrough, and a predetermined conductive pattern 13 is formed on both principal surfaces of the circuit substrate 2. Furthermore, the internal wall of the hollow waveguide 11 is covered with the conductive pattern 13. At a position opposing to one opening of the hollow waveguide 11, a high frequency module 1 is arranged. The hollow waveguide 11 extends to the antenna substrate 4 piercing through the waveguide plate 10. In addition, choke slots 12 are formed so as to surround the hollow waveguide 11.

In the radar 201 having such a configuration, the high frequency module 1 and the antenna substrate 4 forms a structure of a waveguide converter with which high frequency signals can be propagated in both ways as indicated by a dashed arrow A shown in the figure, the high frequency module 1 and the antenna substrate 4 are connected through the hollow waveguide 11, and further, the choke slots 12 are formed so as to surround the hollow waveguide 11. Therefore, the transmission loss between the high frequency module 1 and the antenna substrate 4 can be reduced.

In addition, the structure of an antenna using two pieces of the metallic plates 7 opposing to each other has another advantage that the waveguide converter 8 provides for matching to suppress degradation of the transmission characteristic (loss and reflection) that occurs at a connecting point at which waveguides having different shapes are connected (connecting point between the metallic plate 7 and the antenna substrate 4), a point at which waveguides are branched or combined, or the like can be formed by providing a slot or a projection in the metallic plate 7 (for example, refer to Patent Literature 1).

CITATION LIST

Patent Literature

Patent Literature 1: WO2006/098054

SUMMARY OF THE INVENTION

Technical Problem

However, because in the above connecting structure of waveguides, metallic parts such as the metallic plate 7 are used, there are problems that the number of parts increases which leads to increased weight and cost, and that the thickness of an apparatus increases.

FIG. 7 is a cross section of radar that is supposedly structured such that a microstrip array antenna substrate is integrated with a circuit substrate into one unit. As a solution to the above problems, an antenna apparatus 202 shown in FIG. 7 is provided in which a metallic plate is not used. In the antenna apparatus 202 shown in FIG. 7, by integrating the antenna substrate 4 with the circuit substrate 2 on which a feeder line is provided, minimization of the transmission path and reduction of the number parts are enabled.

However, to form the antenna substrate 4 and the circuit substrate 2 as a single layered substrate, the patterns of the antenna substrate 4 and the circuit substrate 2 and layout of the vias (via 18 forming the waveguide and connection via 19 between the antenna substrate 4 and the circuit substrate 2) are important. For both substrates, many vias 18 and 19 are required around connecting points with the waveguide, and in many cases, positions of the vias overlap each other and the vias cannot be formed at desired positions. Accordingly, a measure to avoid position interference is required to be taken. Therefore, as a processing method of the layered substrate, it is necessary to use the build-up method in which a substrate is formed by laminating conductive layers one layer by one layer.

However, because the accuracy of the order of micrometers (i.e.,μm) is required in dimension and thickness of an antenna for high frequency antennas such as those of 77 GHz band, such a problem arises that the antenna substrate 4 cannot be formed accurately enough in thickness by the build-up method. Moreover, when the antenna substrate 4 is layered on the circuit substrate after the antenna substrate 4 is processed using a core material (double-sided board) in advance without using the build-up method, the vias 18 to connect the antenna substrate 4 and the circuit substrate 2 cannot be formed. As a result, such a problem arises that high frequency signals leak through a layered interface between the substrates.

Furthermore, when the antenna substrate 4 and the circuit substrate 2 are layered into a single unit as described above, a waveguide to be formed in the circuit substrate 2 cannot be a hollow waveguide, and the waveguide has to be a dielectric waveguide 17. As a result, such a problem arises that passing loss increases. This is because when a substrate without a hollow waveguide is laminated on a substrate with a hollow waveguide, a laminated resin material (prepreg) flows into the waveguide during the substrate laminating process, or plating or cleaning liquid is left inside a waveguide hole (position) one side of which is closed during the plating in the finishing process, and as a result, plating cannot be processed while the quality of the inner wall of the waveguide is maintained.

The present invention is achieved to solve the above problems, and it is an object of the present invention to provide a connecting structure of a waveguide converter that has a substrate in which a hollow waveguide to propagate high frequency signals is provided and a substrate that is layered on this substrate and in which a transmission line to propagate high frequency signals is provided, and that can suppress a leak of the high frequency signals through a connection interface between the two substrates, and the hollow waveguide of which can be easily formed, achieving low loss. Furthermore, it is an object of the present invention to provide an antenna apparatus in which the structure of the waveguide converter is applied.

Solution to the Problem

In order to solve the above problem and in order to attain the above object, a connecting structure of a waveguide converter according to the present invention, includes: a first substrate in which a hollow waveguide that propagates a high frequency signal is formed in a pierced manner; and a second substrate that is layered on the first substrate, and in which a converter that is arranged at a connecting point with the hollow waveguide and a transmission line that extends from the converter and that propagates the high frequency signal are provided. A choke structure to shield a leak of the high frequency signal is arranged around the hollow waveguide on a surface of the first substrate opposing to the second substrate so as to surround the hollow waveguide keeping a predetermined interval from the hollow waveguide, and the first substrate and the second substrate are fixed to each other by a fixing unit that is arranged at a position outside the choke structure between the substrates.

Additionally, an antenna apparatus according to the present invention, includes: a high frequency module that inputs and outputs a high frequency signal; a circuit substrate in which a hollow waveguide that propagates the high frequency signal is formed in a pierced manner; and an antenna substrate that is layered on the circuit substrate, and that includes a converter that is provided at a connecting point with the hollow waveguide, a transmission line that is extended from the converter and that propagates the high frequency signal, and an antenna device that is connected to the transmission line. A choke structure to shield a leak of the high frequency signal is arranged around the hollow waveguide on a surface of the circuit substrate opposing to the antenna substrate so as to surround the hollow waveguide keeping a predetermined interval from the hollow waveguide, and the circuit substrate and the antenna substrate are fixed to each other by a fixing unit that is arranged at a position outside the choke structure, between the substrates.

More additionally, a manufacturing method of a waveguide converter according to the present invention, includes: fabricating a first substrate and a second substrate separately, the first substrate including a hollow waveguide that propagates a high frequency signal and a choke structure that is arranged around the hollow waveguide at a predetermined interval from the hollow waveguide so as to surround the hollow waveguide, the second substrate including a converter and a transmission path that extends from the converter and that propagates the high frequency signal; laminating the first substrate and the second substrate in such a manner that the hollow waveguide and the converter are positioned so as to correspond with each other; and fixing the first substrate and the second substrate by adhesive that is sandwiched between the substrates at a position outside the choke structure.

Advantageous Effects of the Invention

According to the present invention, in a waveguide converter that has a substrate in which a hollow waveguide that propagates high frequency signals is provided and a substrate that is layered on this substrate and in which a transmission line that propagates the high frequency signals is provided, a leak of high frequency signals through a connection interface between the two substrates can be suppressed and the hollow waveguide can be formed easily, and accordingly, low loss is achieved.

DETAILED DESCRIPTION OF EMBODIMENTS

Embodiments of a connecting structure of a waveguide converter, a manufacturing method thereof, and an antenna apparatus in which the connecting structure is applied according to the present invention are explained in detail below with reference to the drawings. The present invention is not limited by the embodiments. Like features in different drawing figures are designated by the same reference number or label.

First Embodiment

Figure 1:
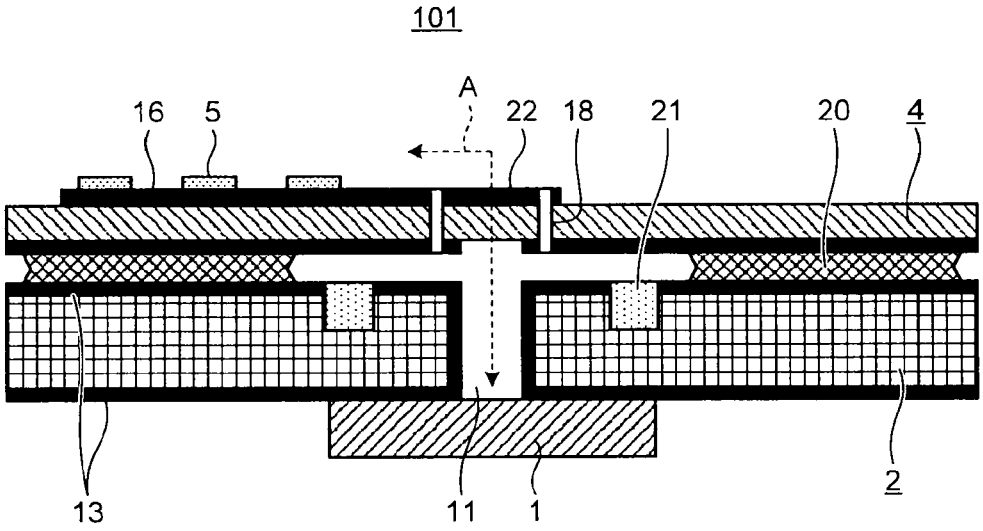
FIG. 1 is a cross section illustrating a first embodiment of a connecting structure of a waveguide converter according to the present invention, and an antenna apparatus in which the connecting structure is applied.
Figure 2:
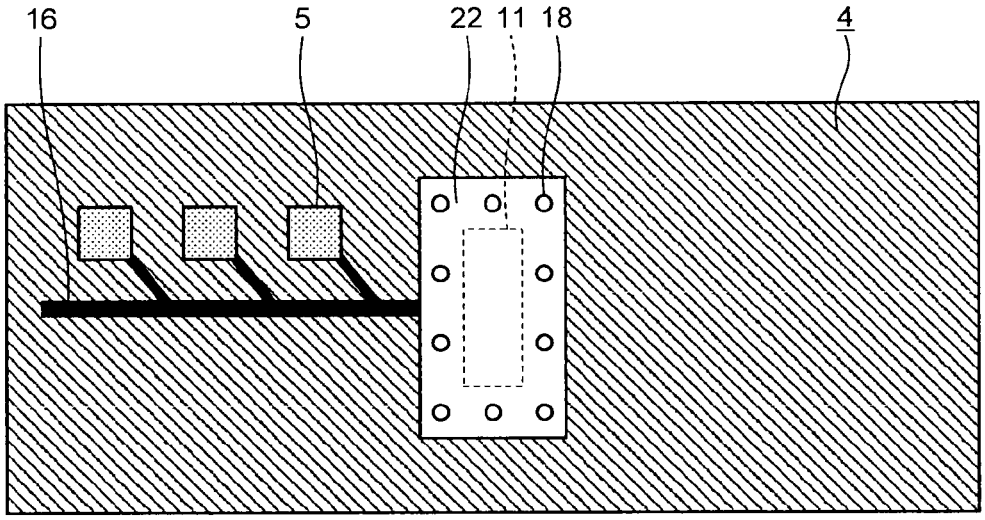
FIG. 2 is a top view of an antenna substrate shown in FIG. 1 when viewed from an antenna side.
Figure 3:
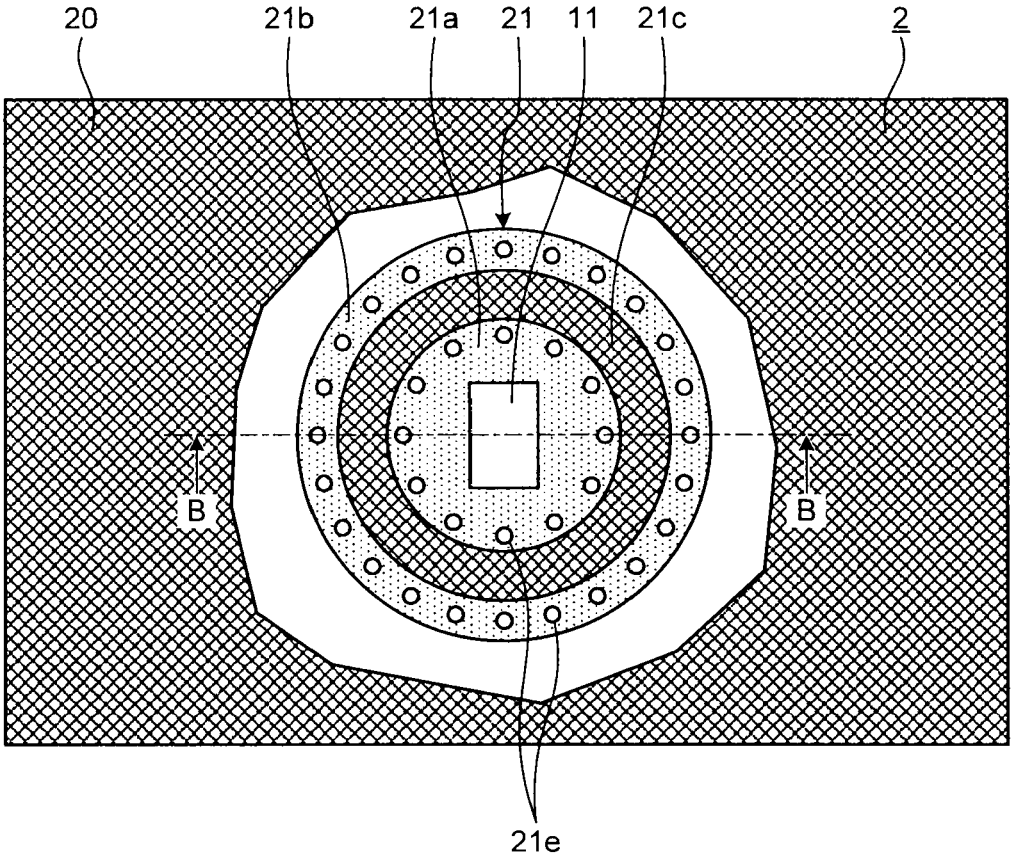
FIG. 3 is a view of a circuit substrate shown in FIG. 1 when viewed from the antenna side (the antenna substrate is not illustrated).
Figure 4:
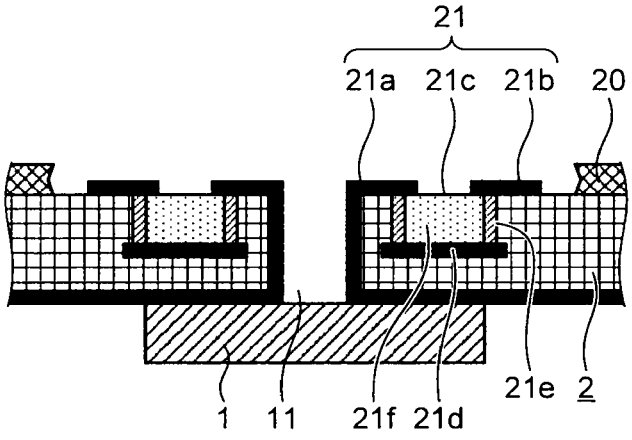
FIG. 4 is a section view taken along a line B-B in FIG. 3, illustrating details of a choke circuit.

FIG. 1 is a cross section illustrating a first embodiment of a connecting structure of a waveguide converter according to the present invention, and an antenna apparatus in which the connecting structure is applied. FIG. 2 is a top view of an antenna substrate shown in FIG. 1 when viewed from an antenna side. FIG. 3 is a view of a circuit substrate shown in FIG. 1 when viewed from the antenna side (the antenna substrate is not illustrated). FIG. 4 is a section view taken along a line B-B in FIG. 3, illustrating details of a choke circuit. An antenna apparatus 101 is applied to millimeter-wave or micrometer wave radar, such as FM/CW radar, and the like.

As shown in FIG. 1, antenna apparatus 101 includes a high frequency module 1 that inputs and outputs high frequency signals of microwave or millimeter-wave bands, a circuit substrate (first substrate) 2 in which a hollow waveguide 11 that propagates high frequency signals is formed, and a microstrip array antenna substrate (first substrate) 4 on which antenna devices 5 are mounted. The hollow waveguide 11 and a microstrip line 16 transmit, between the high frequency module 1 and the antenna devices 5, transmission electromagnetic signals that are output from the high frequency module 1 to the antenna devices 5 or reception electromagnetic signals that are input from the antenna devices 5 to the high frequency module 1. These transmission and reception electromagnetic signals are referred to as high frequency signals together. Among constituents of the antenna apparatus 201, elements except the high frequency module 1 and the antenna devices 5 form the structure of the waveguide converter that can propagate the high frequency signals in both ways as indicated by the dashed line A in the figure.

The circuit substrate 2 is fabricated with a substrate material such as resin, for example, and the conductive pattern 13 is formed on both principal surfaces thereof, and various electronic parts (not shown) are mounted thereon. In the circuit substrate 2, the hollow waveguide 11 is formed in a pierced manner. The internal wall of the hollow waveguide 11 is covered with the conductive pattern 13. On a second principal surface (at a lower side in FIG. 1) not opposing to the antenna substrate 4 of the circuit substrate 2, high frequency module 1 is arranged at a position opposing to the opening of the hollow waveguide 11. The hollow waveguide 11 extends to the antenna substrate 4 piercing through the circuit substrate 2 so as to propagate microwave or millimeter wave high frequency signals that are generated by the high frequency module 1 to the antenna substrate 4. On a first principal surface (at an upper side in FIG. 1) of the circuit substrate 2, a choke circuit (choke structure) 21 is formed so as to surround the hollow waveguide 11. In FIG. 1, the choke circuit 21 is illustrated simply, and the details are described later.

The antenna substrate 4 is layered on the first principal surface of the circuit substrate 2. The antenna substrate 4 uses, for example, a core substrate (a substrate material on which conductors are put in advance on both sides of a resin material) whose thickness is controlled. As shown in FIG. 2, the vias 18 that pierce through the antenna substrate 4 are formed aligned in a rectangular shape so as to surround the rectangular opening of the hollow waveguide 11, at a position opposing to the hollow waveguide 11. Further, on the first principal surface of the antenna substrate 4, which is on the opposite side to the circuit substrate 2, an antenna converter (converter) 22 is provided at a position opposing to the hollow waveguide 11.

Furthermore, on the first principal surface of the antenna substrate 4, the microstrip line (transmission line) 16 that extends from the antenna converter 22 is linearly formed. Along the microstrip line 16, the antenna devices 5 are placed, and each of the antenna devices 5 is connected to a strip line that is branched off from the microstrip line 16.

The circuit substrate 2 and the antenna substrate 4 are manufactured separately through the entire process (for example, from lamination of substrates to the completion of plating process through pattern processing) to the completion of substrates, and thereafter, the substrates are fixed together by adhesive (fixing unit) 20 that is applied so as to be sandwiched between both substrates, as shown in FIG. 1. The adhesive 20 is provided at a position outside the choke circuit 21, being sandwiched between the circuit substrate 2 and the antenna substrate 4. As the adhesive 20, it is desirable to use a non-conductive sheet adhesive having such viscosity that the adhesive does not flow out at the time of application, and having predetermined thickness that is thinner than the thickness of the antenna substrate 4 and the circuit substrate 2, for example. By sandwiching the adhesive 20 constituted by a sheet adhesive between the circuit substrate 2 and the antenna substrate 4, and by applying pressure at predetermined temperature and predetermined pressure, it is possible to set the interval between the circuit substrate 2 and the antenna substrate 4 to be within a predetermined distance range. Thus, a gap of a predetermined distance can be arranged between the circuit substrate 2 and the antenna substrate 4 around the choke circuit 21. Moreover, when applying the pressure, an edge of the adhesive 20 is arranged at a position away from the choke circuit 21 at a predetermined interval in advance to the application of the pressure so that the edge of the adhesive 20 does not reach the choke circuit 21.

The details of the choke circuit 21 are explained with respect to FIGS. 3 and 4. The choke circuit 21 includes an inner-surface conductive pattern 21*a* that is formed around the hollow waveguide 11 on the first principal surface, an outer-surface conductive pattern 21*b* that is formed around the inner-surface conductive pattern 21*a* keeping a predetermined space therefrom, a conductor opening 21*c* that is formed between the inner-surface conductive pattern 21*a* and the outer-surface conductive pattern 21*b*, and at which dielectric is exposed, an internal layer conductor 21*d* (FIG. 4)that is formed at a position away from this conductor opening 21*c* at a predetermined distance in the direction of thickness (direction of depth) of the circuit substrate 2, and a short stub dielectric transmission path 21*f* (FIG. 4)that is formed by a plurality of vias (through conductors) 21*e* that connect the internal layer conductor 21*d* with the inner-surface conductive pattern 21*a* and the outer-surface conductive pattern 21*b*.

In the connecting structure of a waveguide converter having such a configuration and in the antenna apparatus 101 using this connecting structure, in the circuit substrate 2, the hollow waveguide 11 is formed as a transmission path extending from the high frequency module 1, and has the choke circuit 21 to shield high frequency signals at a position at a predetermined interval from the hollow waveguide 11. The choke circuit 21 shields a leak of high frequency signals from the connection interface between the circuit substrate 2 and the antenna substrate 4. With the choke circuit 21 configured as above, a leak of high frequency signals can be suppressed even when the circuit substrate 2 and the antenna substrate 4 are not electrically connected, or have a predetermined gap therebetween.

Moreover, because a core substrate whose thickness is controlled can be used as a constituent of the antenna substrate 4 by fabricating the antenna substrate 4 separately from the circuit substrate 2 as described above, it is possible to determine whether the material is good or bad in terms of thickness in advance of substrate fabrication. Therefore, fabrication of defective items may be prevented and the substrates can be manufactured without waste.

Furthermore, by positioning the adhesive 20 so as not to block the choke circuit 21 of the circuit substrate 2, and by fixing the circuit substrate 2 and the antenna substrate 4 by this adhesive 20, the connecting structure of the waveguide converter is achieved for connecting the substrates (in which the hollow waveguide 11 and the strip line 16 are provided).

In the connecting structure of the waveguide converter according to the present embodiment, the circuit substrate 2 and the antenna substrate 4 are not required to be electrically continuous, a low-cost nonconductive adhesive can be used as the adhesive 20. The fixing material to fix the circuit substrate 2 and the antenna substrate 4 is not limited to the adhesive 20, and a method such as a double-sided tape, soldering, and welding (fix by melting resin) can be used.

Second Embodiment

Figure 5:
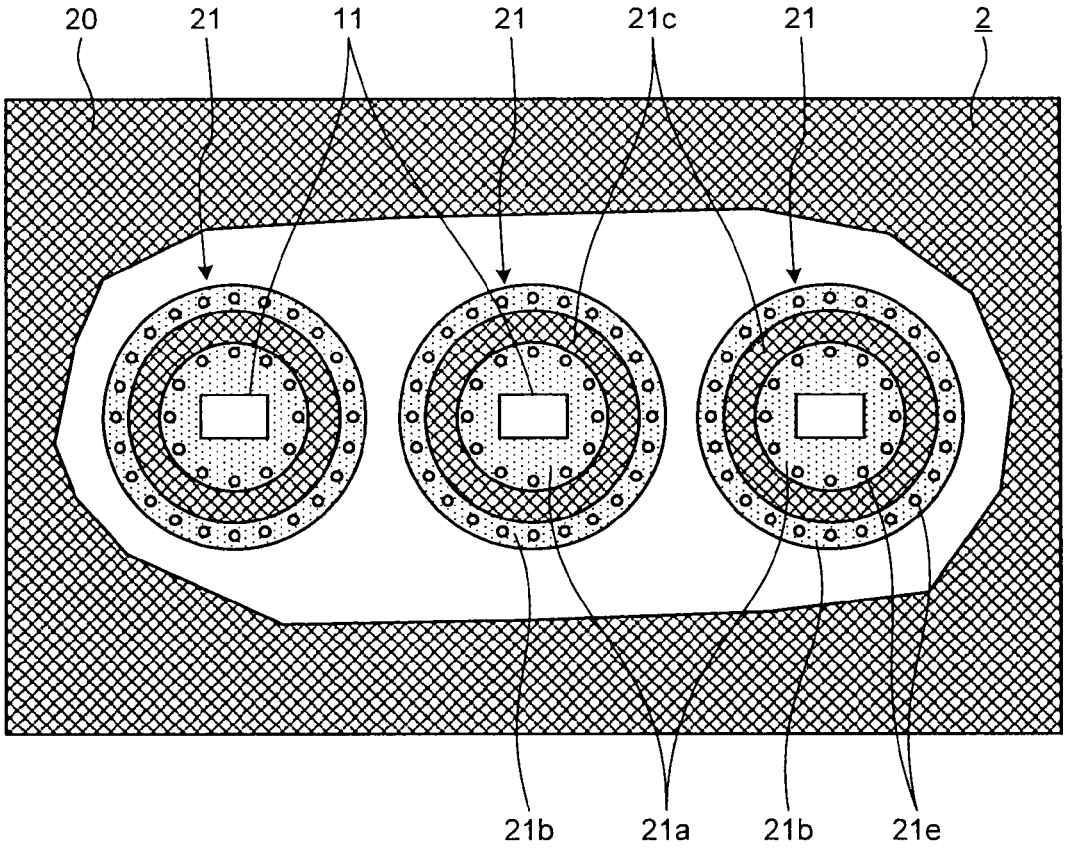
FIG. 5 is a view illustrating a second embodiment of a connecting structure of a waveguide converter according to the present invention, and an antenna apparatus in which the connecting structure is applied when viewed from an antenna side (an antenna substrate is not illustrated).
Figure 6:
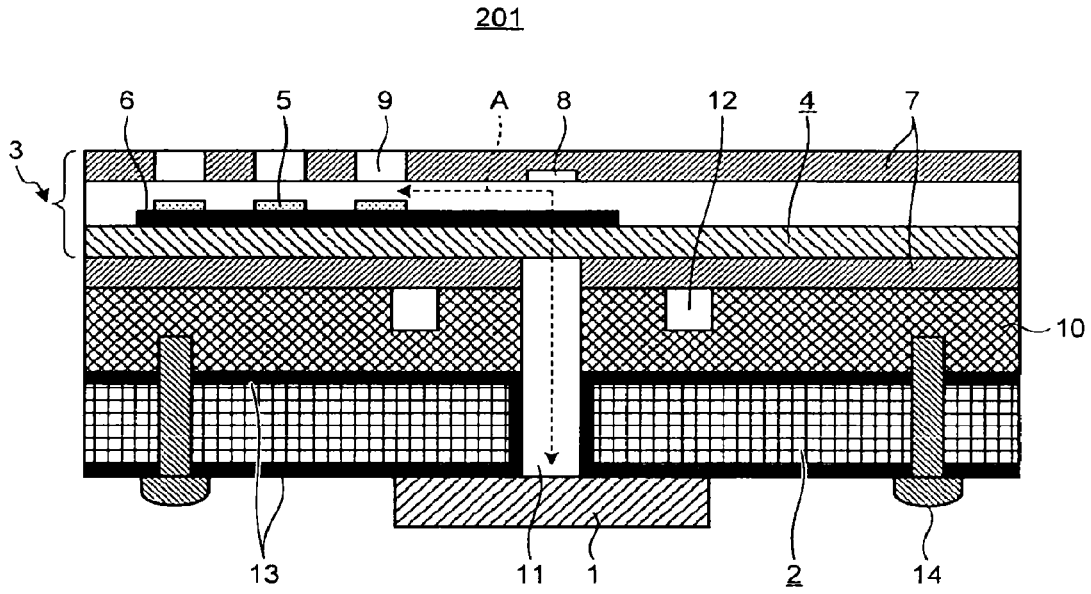
FIG.6 BACKGROUND ART
FIG. 6 is a cross section illustrating an example of a conventional structure of radar equipped with a triplate antenna.
Figure 7:
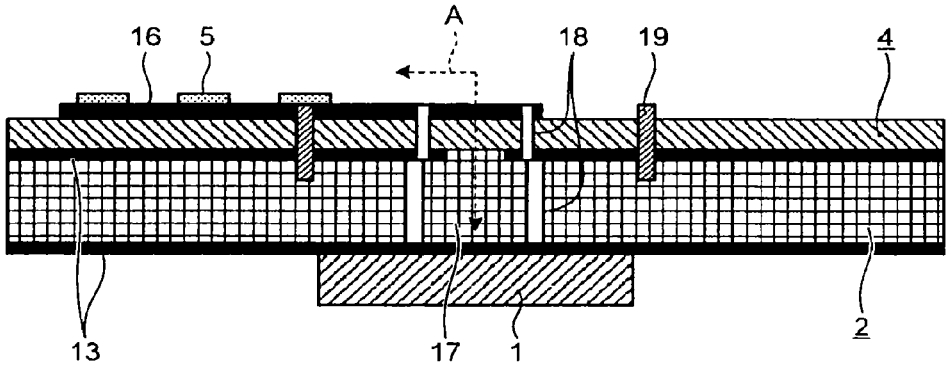
FIG.7 BACKGROUND ART
FIG. 7 is a cross section of a conventional radar that is supposedly structured such that a microstrip array antenna substrate is integrated with a circuit substrate into one unit.

FIG. 5 is a view illustrating a second embodiment of a connecting structure of a waveguide converter according to the present invention, and an antenna apparatus in which the connecting structure is applied when viewed from an antenna side (an antenna substrate is not illustrated). In the present embodiment, three units of the hollow waveguides 11 and the choke circuits 21 are arranged in the circuit substrate 2. Such a configuration with multiple number of the hollow waveguides 11 is adopted when multiple transmission or reception channels are provided in a radar. Because, in such a configuration, a distance between the hollow waveguides 11 adjacent to each other are generally short, it is difficult to fix the choke circuits 21 so as to surround each of the circuits independently with adhesive. Accordingly, in the present embodiment, the adhesive 20 is arranged so as to surround the choke circuits 21 together. Therefore, even when the hollow waveguides 11 are arranged in plurality, a stable connecting structure between the circuit substrate 2 and the antenna substrate 4 can be achieved.

INDUSTRIAL APPLICABILITY

As described above, the connecting structure of a waveguide converter according to the present invention, and the antenna apparatus in which this connecting structure is applied are suitable for small antennas that are used in microwave or millimeter-wave radar or communication devices.

REFERENCE SIGNS LIST

1 HIGH FREQUENCY MODULE
2 CIRCUIT SUBSTRATE (FIRST SUBSTRATE)
3 TRIPLATE ANTENNA
4 ANTENNA SUBSTRATE (SECOND SUBSTRATE)
5 ANTENNA DEVICE
6 ANTENNA LINE
7 METALLIC PLATE
8 WAVEGUIDE CONVERTER
9 VIA
10 WAVEGUIDE PLATE
11 HOLLOW WAVEGUIDE
12 CHOKE SLOT
13 CONDUCTIVE PATTERN
14 FIXING SCREW
16 MICROSTRIP LINE (TRANSMISSION LINE)
17 DIELECTRIC WAVEGUIDE
18 VIA
19 CONNECTION VIA BETWEEN ANTENNA SUBSTRATE AND CIRCUIT SUBSTRATE
20 ADHESIVE (FIXING MATERIAL)
21 CHOKE CIRCUIT (CHOKE STRUCTURE)
21*a* INNER-SURFACE CONDUCTIVE PATTERN
21*b* OUTER-SURFACE CONDUCTIVE PATTERN
21*c* CONDUCTOR OPENING
21*d* INTERNAL LAYER CONDUCTOR
21*e* VIA (THROUGH CONDUCTOR)
21*f* DIELECTRIC TRANSMISSION PATH
22 ANTENNA CONVERTER (CONVERTER)
101 ANTENNA APPARATUS

The invention claimed is:

1. A connecting structure of a waveguide converter, comprising:

a first substrate pierced by a hollow waveguide that propagates a high frequency signal;

a second substrate that is layered on the first substrate, an inner-surface conductive pattern being formed on the surface of the first substrate opposing the second substrate;

a high frequency module that inputs and outputs a high frequency signal is arranged on a side of the first substrate facing away from the second substrate;

an antenna converter is arranged on a side of the second substrate facing away from the first substrate and immediately adjacent to a connecting point with the hollow waveguide to propagate the high frequency signal through the hollow waveguide to and from the high frequency module; and a transmission line that extends away from the antenna converter and the hollow waveguide and that propagates the high frequency signal, the transmission line is provided on the second substrate, wherein a choke structure to shield a leak of the high frequency signal is arranged around the hollow waveguide on the surface of the first substrate opposing to the second substrate so as to surround the hollow waveguide keeping a predetermined interval from the hollow waveguide through the inner surface conductor pattern, and the first substrate and the second substrate are fixed to each other by a fixing unit that is arranged at a position outside the choke structure between the first and second substrates.

2. The connecting structure of the waveguide converter according to claim 1, wherein the choke structure includes the inner-surface conductive pattern being formed around the hollow waveguide on the surface of the first substrate opposing to the second substrate, an outer-surface conductive pattern that is formed around the inner-surface conductive pattern leaving an interval therefrom, a conductor opening that is formed between the inner-surface conductive pattern and the outer-surface conductive pattern, and at which dielectric is exposed, an internal layer conductor that is formed at a position away from the conductor opening at a predetermined distance in a direction in which the first substrate is layered, and a short stub dielectric transmission path that is formed by a plurality of through conductors that connect the internal layer conductor with the inner-surface conductive pattern and the outer-surface conductive pattern.

3. The connecting structure of the waveguide converter according to claim 1, wherein the first substrate and the second substrate are fabricated separately by independent processes to be fixed by the fixing unit.

4. The connecting structure of the waveguide converter according to claim 1, wherein plural sets of the hollow waveguide and the choke structure are arranged, and the fixing unit is arranged so as to surround the plural sets together.

5. The connecting structure of the waveguide converter according to claim 1, wherein the fixing unit is adhesive that is arranged at a position outside the choke structure so as to be sandwiched between the first substrate and the second substrate.

6. The connecting structure of the waveguide converter according to claim 5, wherein the adhesive is nonconductive adhesive.

7. The connecting structure of the waveguide converter according to claim 1, wherein the second substrate uses a core substrate whose thickness is controlled.

8. An antenna apparatus comprising:

a high frequency module that inputs and outputs a high frequency signal;

a circuit substrate pierced by a hollow waveguide that propagates the high frequency signal;

an antenna substrate layered on the circuit substrate, and the high frequency module is arranged on a side of the circuit substrate facing away from the antenna substrate, an inner-surface conductive pattern being formed on the surface of the circuit substrate opposing the antenna substrate;

an antenna converter provided on a side of the antenna substrate facing away from the circuit substrate and immediately adjacent to a connecting point with the hollow waveguide to propagate the high frequency signal to and from the high frequency module;

a transmission line that extends away from the converter and the hollow waveguide, the transmission line is provided on the antenna substrate and propagates the high frequency signal; and an antenna device that is connected to the transmission line and is provided on the antenna substrate, wherein a choke structure to shield a leak of the high frequency signal is arranged around the hollow waveguide on the surface of the circuit substrate opposing to the antenna substrate so as to surround the hollow waveguide keeping a predetermined interval from the hollow waveguide through the inner surface conductor pattern, and the circuit substrate and the antenna substrate are fixed to each other by a fixing unit that is arranged at a position outside the choke structure, between the first and second substrates.

9. The antenna apparatus according to claim 8, wherein plural sets of the hollow waveguide and the choke structure are arranged, and the fixing unit is arranged so as to surround the plural sets together.

10. A manufacturing method of a waveguide converter, comprising:

fabricating a first substrate and a second substrate separately, the first substrate including a hollow waveguide that propagates a high frequency signal, a choke structure that is arranged around the hollow waveguide on the surface of the first substrate opposing the second substrate at a predetermined interval from the hollow waveguide so as to surround the hollow waveguide, and a surface conductive pattern formed on the surface of the first substrate opposing the second substrate has been inserted after, the second substrate including an antenna converter arranged at a connecting point with the hollow waveguide and a transmission path that extends from the converter and that propagates the high frequency signal;

laminating the first substrate and the second substrate in such a manner that the hollow waveguide and the converter are positioned so as to correspond with each other;

fixing the first substrate and the second substrate by adhesive that is sandwiched between the first and second substrates at a position outside the choke structure; and arranging a high frequency module that inputs and outputs a high frequency signal on a side of the first substrate facing away from the second substrate, and arranging the antenna converter on a side of the second substrate facing away from the first substrate and immediately adjacent to the connecting point with the hollow waveguide to propagate the high frequency signal through the hollow waveguide to and from the high frequency module.

11. The manufacturing method of a waveguide converter according to claim 10, wherein the second substrate uses a core substrate whose thickness is controlled.

* * * * *